United States Patent [19]

Eulenfeld

[11] 4,245,564

[45] Jan. 20, 1981

[54] CENTER BEARING SOCKET CONSTRUCTION

[75] Inventor: Karl-Heinz Eulenfeld, Berg.-Gladbach, Fed. Rep. of Germany

[73] Assignee: Waggon Union GmbH, Fed. Rep. of Germany

[21] Appl. No.: 899,855

[22] Filed: Apr. 25, 1978

Related U.S. Application Data

[63] Continuation of Ser. No. 727,249, Sep. 27, 1976, abandoned.

[30] Foreign Application Priority Data

Oct. 24, 1975 [DE] Fed. Rep. of Germany ..... 2547605

[51] Int. Cl.[3] ..... B61F 5/16; B61F 5/50; F16C 17/04; F16C 27/08

[52] U.S. Cl. ..... 105/199 C; 105/200; 308/137

[58] Field of Search ..... 105/199 C, 200, 189; 308/137

[56] References Cited

U.S. PATENT DOCUMENTS

| | | | |
|---|---|---|---|
| 2,509,955 | 5/1950 | Barnes | 105/199 C |
| 3,257,969 | 6/1966 | Thomas | 105/199 C |
| 3,326,611 | 6/1967 | Christian | 308/137 |
| 3,405,654 | 10/1968 | Dilg | 105/199 C |
| 3,667,820 | 6/1972 | Scherrick | 308/137 |
| 3,986,752 | 10/1976 | Bogar et al. | 105/199 C |

FOREIGN PATENT DOCUMENTS

| | | | |
|---|---|---|---|
| 1094289 | 12/1960 | Fed. Rep. of Germany | 105/200 |

*Primary Examiner*—Howard Beltran
*Attorney, Agent, or Firm*—McGlew and Tuttle

[57] ABSTRACT

A bearing socket for the pin connection of trucks to the body of rail vehicles comprises an upwardly opening cup-shaped lower part having a pivot pin receiving bore for the path of the pivot pin. An upwardly opening cup-shaped insert of resilient material is disposed within the lower part and has an annular side wall and a bottom wall with approximately the same thickness throughout. An upwardly opening cup-shaped upper part is disposed within the insert and both the insert and the upper part have bores for accommodating the pivot pin. The lower part advantageously has a hub portion and the insert is cut away and has a bead-shaped protuberance formed around the cut away portion surrounding the hub of the lower part. The outer walls of both the insert and the upper and lower parts are conically formed and shaped so that they interengage. The insert is prestressed and fixed between the upper and lower parts so that it absorbs the rotary motion of the bearing by elastic deformation without any sliding between the insert and the upper and lower parts.

5 Claims, 1 Drawing Figure

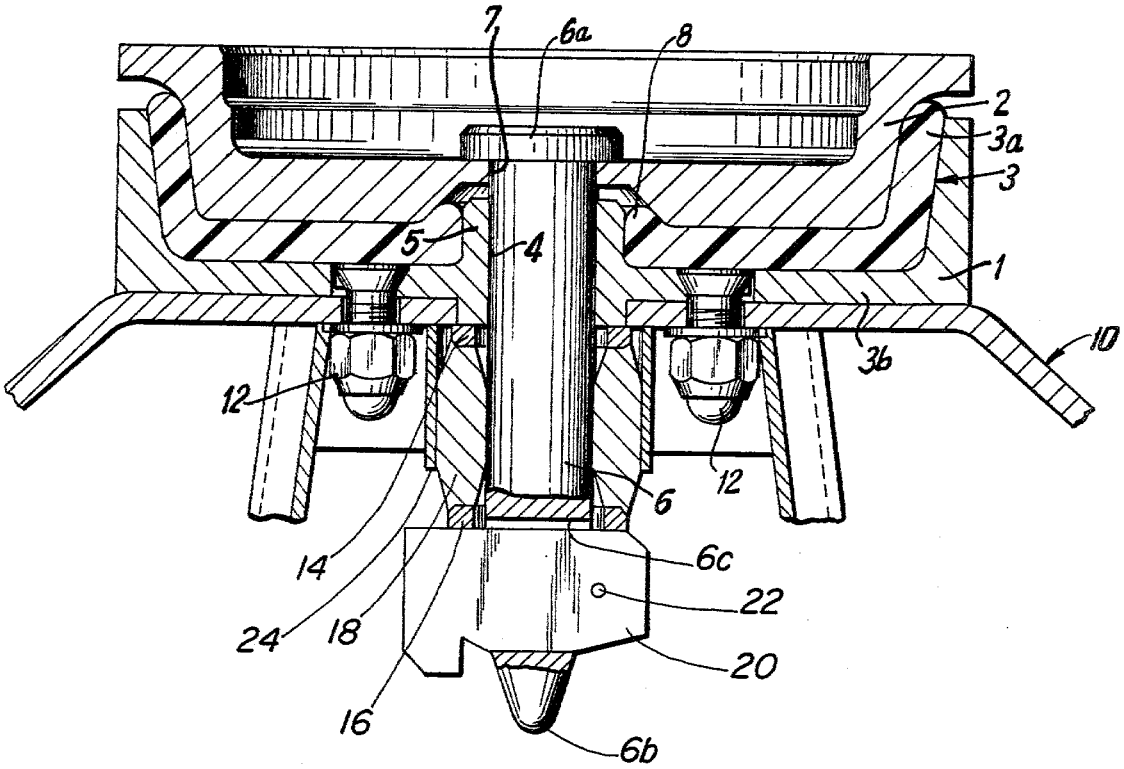
7
6a
8
2
3a
3
5
4
1
10
3b
12
12
6
6c
22
14
24
18
20
16
6b

CENTER BEARING SOCKET CONSTRUCTION

This application is a continuation in part of my abandoned application, Ser. No. 727,249 filed Sept. 27, 1976.

BACKGROUND OF THE INVENTION

1. Field of the Invention

This invention relates in general to the construction of bearing assemblies and in particular to a new and useful bearing socket construction for connecting particularly movable beam type trucks to the body of railroad vehicles.

2. Description of the Prior Art

The present invention is particularly concerned with the construction of bearing sockets which are used for the undercarriages of high speed rail vehicles. In such an assembly the cup or cup shaped parts of the bearing socket engage each other horizontally in frictional contact and they form an exact horizontal guide for the movable beam of the truck which is suspended for swinging or oscillation from the frame of the truck. In such a bearing socket construction it is well known to provide a flat disc of plastic or felt or similar material which is received between the horizontal surfaces of the bearing socket parts. Such a disc serves for the purpose of reducing the wear reducing the coefficient of friction, and providing an anti-seizure lubrication. A disadvantage of the known construction is the relatively short life of the disc and the transmission of the riding noise of the truck to the car body as well as the cost of maintenance of the bearing socket.

A known design of a spherical bearing socket for a railroad freight car includes a disc shaped rubber metal intermediate body which is inserted between the parts of the socket. The rubber metal insert comprises one or a plurality of layers of rubber and on the outside or inside sheet metal shells are vulcanized to the rubber. Such a rubber metal insert is placed loosely between the lower and the upper parts of the bearing socket. The cross-section of the rubber portions increases from the axis of the bearing socket toward the outside in order to absorb the longer travel necessarily covered at the outside during a rotational movement of the bearing socket by an inner deformation. In such a design it is disadvantageous that the relatively large cross-section of the rubber prevents an accurate guidance of the truck by the bearing socket. For this reason the design cannot be applied to a bearing socket of this type.

SUMMARY OF THE INVENTION

The present invention provides a bearing socket assembly which serves the purpose of connecting in particular a movable beam-type truck to the body of a railroad vehicle. In accordance with the invention the bearing assembly includes a cup-shaped lower part and a cup-shaped upper part with an intermediate elastic insert therebetween which insures that the wear of the contact surfaces between the upper and lower parts is prevented and an accurate guidance of the upper part of the bearing socket in the lower part is maintained. The insert is made of a substantially cup-shaped configuration and has an annular side wall of a thickness which is substantially equal to the horizontal bottom wall. In addition the side surfaces which interengage between the upper and lower parts are formed of a conical configuration complementary to the exterior surface of the annular wall of the upper part of the interior surface of the annular wall of the lower part. The insert is provided with a central bore which applies against the periphery of a hub portion of the lower part an the pin of the bearing socket passes through the hub portion and has a cap which engages over the exterior of the upper portion.

The construction is such that the transmission of riding noise from the truck to the car body is prevented. Also any wear of the contacting surfaces of the lower and upper parts of the bearing socket is also prevented. The maintenance of the bearing socket becomes substantially unnecessary. The accurate guidance of the upper part in the lower part of the bearing socket is maintained. Because of the relatively small throw of the trucks in high speed railroad vehicles an insert can be provided having a uniform wall thickness and the wall thickness can be chosen in accordance with the pivoting angle of the trunk. Due to the load applied to the bearing socket the insert becomes initially prestressed and fixed between said upper and lower parts by the load of the vehicle body thereon whereby the chain modules of the elastic material or rubber are aligned. Local shrinkage stresses are compensated so that the durability of the shear-stressed insert is increased. The insert is firmly positioned due to the frictional adhesion so that a destruction of its surface is avoided. The conical shape of the lateral walls of the lower and upper parts and of the insert insure an easy and non-destructive placing of the insert in position and also facilitate the necessary initial compression stress in the lateral wall.

Accordingly it is an object of the invention to provide a bearing socket for the pin connection of trucks to the bodies of rail vehicles which comprises an upwardly opening cup-shaped lower part having a central pivot pin receiving bore for the passage of the pivot pin and an upwardly opened cup-shaped insert of resilient material disposed within the lower part and having an annular side wall and a bottom wall of approximately the same thickness throughout and further including an upwardly opening cup-shaped upper part disposed within the insert and having a bore for the passage of the pivot pin which aligns with a bore in the lower part.

A further object of the invention is to provide a bearing socket construction for supporting trucks on rail vehicles which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter which illustrate a preferred embodiment of the invention.

BRIEF DESCRIPTION OF THE DRAWING

The only FIGURE of the drawing is a vertical sectional view of a bearing socket constructed in accordance with the invention.

GENERAL DESCRIPTION OF THE PREFERRED EMBODIMENT

Referring to the drawing in particular the invention embodied therein comprises a bearing socket for a truck generally designated 10 of a rail vehicle which is to be mounted to a rail vehicle car body.

In accordance with the invention the bearing socket comprises a lower part 1 which is adapted to be secured to the truck such as by clamping bolts 12 and which is assembled together with a pin 6 to an upper part 2 with an insert 3 disposed therebetween. In accordance with the invention, the lower part 2 of the bearing socket has approximately the shape of a cup and is provided with a central bore 4 for the passage of the central pin 6 of the bearing socket. The inside of the lateral wall of the lower part 1 is conical. The upper part 2 of the bearing socket has approximately the shape of a cap or cup and at least the outer surface of the lateral wall 2 has the same conical shape and inclination as the interior surface of the lateral wall of the lower part of the bearing socket. The upper part 2 is also provided with a central bore 7 for the pin 6 of the socket. The pin 6 includes a cap portion **6*a* at one end which engages over the upper part 2**.

On the other side of the bottom of the upper part 2 of the bearing socket there is a central recess so that with the bearing socket assembled the upper part thereof has a play relative to a hub portion 5 of the lower part 1.

The upper and lower bearing parts are connected to the truck 10 by kingpin 6 which extends downwardly through an opening provided in a spacer 18. Spacer 18 has reduced diameter end portions for receiving the tapered end **6*b* of the kingpin 6 and is held within sleeve 24 which is welded to the truck 10 between rings 14 and 16. Kingpin 6 is provided with a slot 6*c* through which is forced a wedge member 20 for firmly retaining the kingpin on the truck 10. Wedge 20 is held by a cross pin 22** shown.

The insert 3 is placed between the upper part 2 and the lower part 1 and it is of cup-shaped configuration and has a conically extending lateral wall which has an exterior surface conforming to the conical confuguration of the lower part and an interior surface conforming to the conical configuration of the outer wall of the upper part 2. In accordance with a feature of the invention the side wall or annular portion **3*a* is of substantially the same thickness as the horizontal or flat bottom portion 3*b*. The insert 3 is provided with a central bore and the diameter of the bore corresponds to the outer diameter of the hub portion 5 of the lower part 1. The bead formation 8 is defined around the rim of the bore and it surrounds the hub portion 5**.

The insert 3 is prestressed between the upper part 2 and the lower part 1 and is firmly positioned due to frictional adhesion between the upper and lower parts so that it is capable during operation of absorbing the rotary motion of the bearing by elastic deformation. During the operation there is no sliding between the insert and the upper and lower parts but only a torsional twisting of the insert.

When the bearing socket is assembled the design insures that the insert 3 is enclosed between the metal parts of the bearing socket almost at all sides so that a squeezing or flowing out of the insert is prevented.

While a specific embodiment of the invention has been shown and described in detail to illustrate the application of the principles of the invention, it will be understood that the invention may be embodied otherwise without departing from such principles.

What is claimed is:

1. A bearing socket for a pin connection of a truck to the body of rail vehicles, comprising an approximately cup-shaped lower part having a bottom wall with a central bore for the pin and a side wall diverging upwardly, an upwardly-opening cup-shaped insert of resilient material disposed within the lower part and having an annular side wall and a bottom wall which are of substantially the same thickness throughout and have outer bottom and side wall surfaces conformable to the inner bottom and side wall surfaces of said lower part, and an upwardly opening cup-shaped upper part having outer bottom and side wall surfaces conforming to the inner bottom and side wall surfaces of said insert, said insert being fixed by frictional adhesion between said upper and lower parts caused by the load of the said vehicle body so that said insert separates said surfaces of said upper and lower parts, respectively, and absorbs the rotary motion of the bearing by elastic deformation, a sleeve connecting and extending from the truck, an annular spacer positioned in said sleeve with a central opening of a diameter to receive said pin, said pin having a slot therethrough at a position below said spacer, and a wedge member engaged in said slot of said pin and bearing against said spacer for retaining said pin within said spacer.

2. A bearing socket according to claim 1, wherein said lower part includes a lateral wall having an inner surface of frusto conical form, said upper part having a lateral wall with an exterior surface of frusto conical form and said insert having a lateral surface disposed between the lateral surfaces of said upper and lower part has an outer surface of complementary form to the outer surface of the lower part and an inner surface of a complementary frusto conical form to the exterior surface of the upper part.

3. A bearing socket according to claim 1, wherein said insert includes a central bore, said lower part having a hub portion located within the central bore, said insert having an annular bead formation surrounding the bore in said hub portion.

4. A bearing socket according to claim 1, wherein said insert comprises a rubber material.

5. A bearing socket according to claim 1, wherein said spacer has top and bottom tapered portions, said pin having a bottom tapered portion, upper and lower retaining rings disposed on either side of said spacer and a locking member extending through said wedge member for retaining said wedge member in said pin slot.

* * * * *